United States Patent [19]

Denjean

[11] 4,174,748

[45] Nov. 20, 1979

[54] HEAT-EXCHANGER WITH ROTOR HAVING RADIAL PASSAGES

[75] Inventor: René Denjean, Pavillons-sous-Bois, France

[73] Assignee: Air Industrie, France

[21] Appl. No.: 856,632

[22] Filed: Dec. 2, 1977

[30] Foreign Application Priority Data

Dec. 7, 1976 [FR] France ..... 76 36797

[51] Int. Cl.[2] ..... F28D 19/00

[52] U.S. Cl. ..... 165/5; 165/9

[58] Field of Search ..... 165/5, 7, 9, 6, 8

[56] References Cited

U.S. PATENT DOCUMENTS

| | | | |
|---|---|---|---|
| 1,603,026 | 10/1926 | Cook | 165/7 X |
| 3,003,750 | 10/1961 | Hess | 165/9 |
| 3,027,144 | 3/1962 | Hess et al. | 165/9 |
| 3,122,200 | 2/1964 | Koch | 165/9 |
| 3,315,729 | 4/1967 | Mondt | 165/9 |

FOREIGN PATENT DOCUMENTS

| | | | |
|---|---|---|---|
| 1170106 | 2/1962 | Fed. Rep. of Germany | 165/6 |

*Primary Examiner*—Albert W. Davis, Jr.

*Attorney, Agent, or Firm*—Ostrolenk, Faber, Gerb & Soffen

[57] ABSTRACT

A dynamic heat-exchanger with rotor having radial passages disposed, in relation to two circulation ducts, so that there flows radially therethrough, on one sector, a hot fluid flowing in one of the two ducts, and, on another sector, a cold fluid flowing in the other duct. This exchanger comprises a fluid jet cleaner provided for acting by blowing in the passages of the rotor, this blowing taking place between two facing outer and inner sealing zones disposed on the outer and inner cylindrical surfaces of the rotor. This exchanger further comprises a preheater for blowing heated gas through the passages to warm them before hot fluid flows through the passages.

4 Claims, 1 Drawing Figure

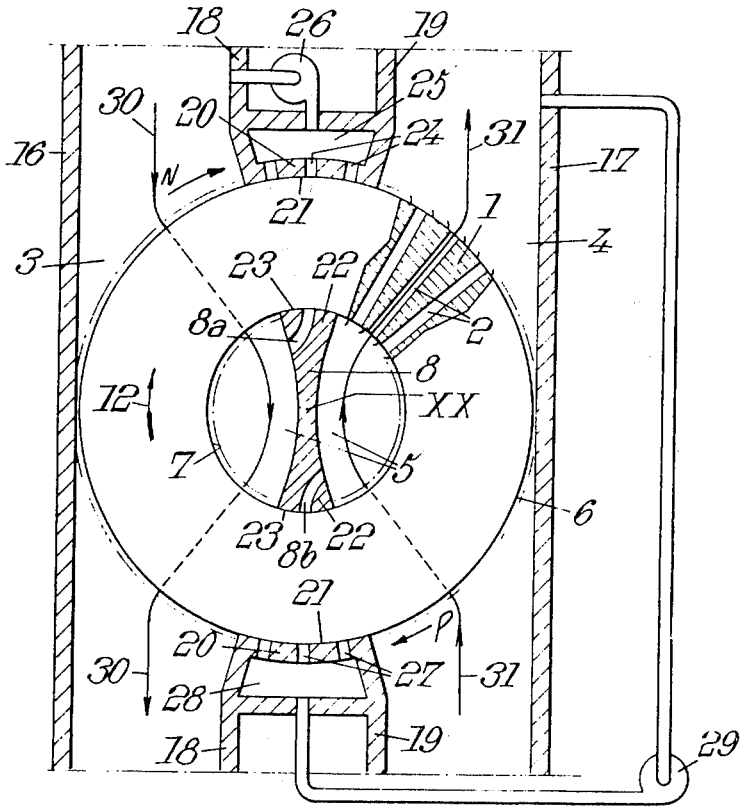
18
26
19
25
30
20
24
31
16
N
17
21
1
4
3
23
22
8a
2
8
12
XX
7
5
6
23
8b
22
27
20
P
30
27
31
28
18
19
29

HEAT-EXCHANGER WITH ROTOR HAVING RADIAL PASSAGES

The invention relates to dynamic heat-exchangers, i.e. exchangers comprising a rotor in which are provided a plurality of passages. This rotor is disposed, in relation to two circulation ducts, so that there flows therethrough, on one sector, a hot fluid flowing in one of the two ducts and, on another sector, a cold fluid flowing in the other duct. Known heat-exchangers of this type have the following characteristics:

The rotor is annular, leaving a central spaced disengaged.

The passages provided in this rotor are radial or substantially radial so as to connect the outer cylindrical surface of the rotor to the inner cylindrical surface of the rotor.

The rotational axis of the rotor is perpendicular to the two circulation ducts, at least immediately adjacent the rotor.

The central space is divided by a dividing wall, which is preferably diametrical and which extends parallel to the two circulation ducts, at least immediately adjacent the rotor.

It has already been proposed to form an outer sealing zone on the outer cylindrical surface of the rotor.

It has also been proposed to provide an inner sealing zone, which may be provided on the inner cylindrical surface of the rotor by giving to the diametrical dividing wall a certain thickness, at least adjacent the inner cylindrical surface.

Exchangers presenting the known characteristics which have just been discussed above are described in the following patents: British Patent No. 1 444 203, U.S. Pat. No. 1,603,026, Swiss Patent No. 391 753 and U.S. Pat. No. 1,843,252.

In these known exchangers two problems arise which the present invention proposes resolving.

The first problem concerns the clogging of the passages of the rotor.

The second problem concerns the risk of condensation in the cold regions of the rotor.

These two problems are important in a particular field of application of the invention, i.e. heat-exchangers between hot fumes escaping from a boiler and cold combustive air being supplied to this boiler.

The fumes may rapidly clog up the passages of the rotor.

The fumes may also condense in the cold regions of the rotor and thus produce corrosive products (particularly acid sulphurated liquids).

To remedy the first of these disadvantages (clogging of the passages of the rotor), cleaning means are provided, namely fluid jets for acting by blowing in the passages of the rotor. This blowing occurs between two facing outer and inner sealing zones.

To remedy the second of these disadvantages (risk of condensation in the cold regions of the rotor), fluid jet pre-heating means are provided to act by blowing in the passages of the rotor. This blowing takes place between the two other facing outer and inner sealing zones.

According to an advantageous embodiment, these cleaning means comprise, at least one aperture emerging into an outer sealing zone and which is supplied with fluid taken from upstream of the exchanger through pressure raising means, and at least one duct starting from the corresponding inner sealing zone and emerging in the part of the central space corresponding to the duct in which flows the fluid taken.

According to this same embodiment, these pre-heating means comprise, at least one aperture emerging into the outer sealing zone and which is supplied with fluid taken from downstream of the exchanger through pressure raising means, and at least one duct starting from the corresponding inner sealing zone and emerging into the part of the central space corresponding to the duct in which flows the fluid taken.

The single FIGURE of the accompanying drawings is a schematic section of a dynamic heat-exchanger according to the invention.

This FIGURE shows a dynamic heat-exchanger for exchanging heat between fumes escaping from a boiler (not shown) and the combustive air being supplied to this boiler. Such an exchanger operates as a heat recuperator.

This exchanger comprises a rotor 1, in which are provided a plurality of passages 2, and two vertical circulation ducts, comprised of duct 3 through which the fumes pass downwards and duct 4 through which the combustive air passes upwards.

This rotor 1 is disposed, in relation to these two circulation ducts 3 and 4, so that the fumes flowing in duct 3 flow through one sector of the rotor and, the combustive air flowing in duct 4 flows through another sector of the rotor.

Rotor 1 is annular in shape leaving a central open space 5 disengaged. Passages 2, provided in rotor 1 are radial, or substantially radial in their orientation, so as to connect the outer cylindrical surface 6 of rotor 1 to the inner cylindrical surface 7 of rotor 1.

The rotational axis X—X of rotor 1 is perpendicular to circulation ducts 3 and 4, at least immediately adjacent rotor 1.

Central space 5 is divided by a diametrical dividing wall 8 that is parallel to circulation ducts 3 and 4, at least immediately adjacent rotor 1.

The diameter of rotor 1 is approximately equal to the distance between facing walls 16 and 17 of the two circulation ducts 3 and each duct has a respective inner wall, 18 and 19. The width of each circulation duct is less than the outer radius of rotor 1.

A connecting wall 20, corresponding in shape to the outer cylindrical surface 6 of rotor 1, connects the two inner walls 18 and 19. The connecting wall 20 defines an outer sealing zone 21 on this outer cylindrical surface 6.

At both ends, the diametrical dividing wall 8 has, adjacent the inner cylindrical surface 7 of the rotor, a thickness 22 whose end contour corresponds in shape to the inner cylindrical surface 7. The thickness 22 defines an inner sealing zone 23 on inner cylindrical surface 7.

These two outer 21 and inner 23 sealing zones form a labyrinth type joint, which avoids the need to sealing devices of the mechanical type with rubbing parts.

Advantageously, the diametrical dividing wall 8 has a thickness which diminishes from thicknesses 22 adjacent inner cylindrical surface 7 of rotor 1. The thickness of wall 8 reaches a minimum value at the axis of rotor 1. Such an arrangement promotes the flow of fumes and combustive air.

Fluid jet cleaning means N blow into passages 2 of rotor 1. This blowing is carried out between the two facing outer 21 and inner 23 sealing zones at the top in the FIGURE.

These cleaning means N may advantageously comprise, at least one aperture 24, and preferably several apertures 24, emerging into the outer sealing zone 21 at the top or these apertures 24 is supplied with fluid taken from upstream of the exchanger. Cleaning means N further comprises at least one duct 8*a* extending through wall 8 starting from the corresponding inner sealing zone 23 and emerging into the part of central space 5 corresponding to the duct 3 in which flows the fluid taken.

The fluid is taken from upstream of the exchanger through pressure raising means 26, such as a fan for example.

When, according to a particular application of the invention, the heat-exchange is operative between fumes and combustive air, the cleaning fluid of the cleaning means is formed by fumes taken from upstream of the exchanger. The blowing of these fumes taking place in passage 2 of rotor 1 as these passages are passing from the fume duct 3 to the combustive air duct 4.

It is advantageous to provide the exchanger with fluid jet pre-heating means P for blowing through passages 2 of rotor 1. This blowing takes place between two other facing outer 21 and inner 23 sealing zones at the bottom of the FIGURE.

These pre-heating means P comprise advantageously, at least one aperture 27, and preferably several apertures 27, emerging into the outer sealing zone 21 at the bottom. This or these apertures 27 being supplied with fluid taken from downstream of the exchanger, and at least one duct 8*b* that starts from the corresponding inner sealing zone 23, at the bottom and emerges into the part of central space 5 corresponding to duct 4 in which flows the fluid taken.

The fluid is taken from downstream of the exchanger through pressure raising means 29, such as a fan.

When the heat exchange is between fumes and combustive air, the pre-heating fluid is formed by combustive air taken from downstream of the exchanger. The blowing of this combustive air takes place in passages 2 of rotor 1 when these latter pass from the combustive air duct 4 to fume duct 3.

There is hereby provided a heat-exchanger which, thanks to these cleaning means and to these pre-heating means, is reliable in operation and needs few maintenance operations.

In the FIGURE, the flow of the fumes is shown by arrows 30 and the flow of combustive air by arrows 31.

I claim:

1. A dynamic heat-exchanger for exchanging heat between fumes of combustion and combustive air, said heat-exchanger comprising:

two circulation ducts, respectively for fumes and combustive air, an annular rotor extending into both said circulation ducts, said rotor having a disengaged central space, said rotor having an outer and an inner cylindrical surface, a dividing wall located in and dividing said central space and extending parallel to the two said circulation ducts, the rotational axis of said rotor being perpendicular to the direction of extension of said two circulation ducts, at least immediately adjacent said rotor, substantially radial passages provided in said rotor so as to connect said outer cylindrical surface to said inner cylindrical surface so that fumes and combustive air flow radially through said rotor in one sector and in another sector of said rotor, respectively, two spaced apart outer sealing zones provided on said outer cylindrical surface of said rotor, a respective inner sealing zone for each said outer sealing zone and being provided on said inner cylindrical surface of said rotor, and fluid jet cleaning means provided for blowing in the passages of the rotor, this blowing taking place between respective first facing outer and inner sealing zones, said fluid jet cleaning means being connected to take fumes from upstream of the exchanger and to blow these fumes in said passages of said rotor when said passages pass from said fume circulation duct to said combustive air circulation duct.

2. An exchanger according to claim 1, further comprising fluid jet pre-heating means for blowing in said passages of the rotor, said pre-heating means being so placed that this blowing takes place between two other facing said outer and inner sealing zones.

3. An exchanger according to claim 2, wherein said pre-heating means comprise, at least one aperture emerging into said other outer sealing zone and being connected with ventilating means for being supplied with combustive air taken from downstream of the exchanger, and at least one duct starting from said other inner sealing zone and emerging combustive air into the part of said central space corresponding to said duct.

4. An exchanger according to claim 1, wherein said cleaning means comprise, at least one aperture emerging into said first outer sealing zone and being connected to ventilating means for being supplied with fumes taken from upstream of the exchanger, and at least one duct starting from said first inner sealing zone and emerging into the part of said central space corresponding to said fume circulation duct.

* * * * *